US012528561B2

(12) United States Patent
Van Hardenbroek Van Ammerstol et al.

(10) Patent No.: US 12,528,561 B2
(45) Date of Patent: Jan. 20, 2026

(54) SAFETY STRUT ASSEMBLY FOR HYDROFOIL CRAFT

(71) Applicant: EDORADO B.V., Dordrecht (NL)

(72) Inventors: Godert Jan Van Hardenbroek Van Ammerstol, Dordrecht (NL); Michael Godefridus Andreas Groothuis, Dordrecht (NL); Joris Reijnders, Breda (NL); Harry Larsen, Seattle, WA (US); Sybren Yme Leijenaar, Sint Nicolaasga (NL)

(73) Assignee: EDORADO B.V., Dordrecht (NL)

( * ) Notice: Subject to any disclaimer, the term of this patent is extended or adjusted under 35 U.S.C. 154(b) by 570 days.

(21) Appl. No.: 18/017,530

(22) PCT Filed: Jul. 22, 2021

(86) PCT No.: PCT/NL2021/050469
§ 371 (c)(1),
(2) Date: Jan. 23, 2023

(87) PCT Pub. No.: WO2022/019764
PCT Pub. Date: Jan. 27, 2022

(65) Prior Publication Data

US 2023/0257073 A1 Aug. 17, 2023

(30) Foreign Application Priority Data

Jul. 24, 2020 (NL) ..... 2026134

(51) Int. Cl.
*B63B 1/24* (2020.01)
*B63B 1/28* (2006.01)
*B63B 1/30* (2006.01)

(52) U.S. Cl.
CPC ..... *B63B 1/244* (2013.01); *B63B 1/242* (2013.01); *B63B 1/248* (2013.01); *B63B 1/28* (2013.01);
(Continued)

(58) Field of Classification Search
CPC ..... B63B 1/24; B63B 1/242; B63B 1/244; B63B 1/246; B63B 1/248; B63B 1/26;
(Continued)

(56) References Cited

U.S. PATENT DOCUMENTS 3,322,089 A * 5/1967 Hook ..... B63B 1/244 114/280
3,342,155 A 9/1967 Hook
(Continued)

FOREIGN PATENT DOCUMENTS

WO 9222396 A2 12/1992
WO 9222396 A3 4/1993

OTHER PUBLICATIONS

International Search Report and Written Opinion of the International Searching Authority issued in corresponding application PCT/NL2021/050469 mailed Jan. 3, 2022 (8 pages).

*Primary Examiner* — Ajay Vasudeva
(74) *Attorney, Agent, or Firm* — Carter, DeLuca & Farrel; Vadim Vapnyar

(57) ABSTRACT

Safety strut assembly (9) for a hydrofoil craft (1) comprising a strut (12), which is attached to the hull (10) of the craft by means of a transverse oriented strut axle (40) for pivotal movement with respect to the hull, the assembly further comprising: a control rod (33) passing down through the strut (12); a linear actuator assembly (28); a hydrofoil (13) pivotally mounted to the bottom portion of the strut (12) about a transverse oriented foil axle (35); first linkage means (34) connecting the hydrofoil (13) to the control rod (33);
(Continued)

wherein the first linkage means (34) comprises a first drive ring (48) mounted around the foil axle (35), wherein the first drive ring is provided with one first ring cam element (45), and wherein the foil axle (35) is provided with one foil axle cam element (46).

16 Claims, 10 Drawing Sheets

(52) U.S. Cl.
CPC ..... *B63B 1/285* (2013.01); *B63B 1/286* (2013.01); *B63B 1/30* (2013.01)

(58) Field of Classification Search
CPC ..... B63B 1/28; B63B 2001/281; B63B 1/283; B63B 1/285; B63B 1/286; B63B 1/30
USPC ..... 114/274–282
See application file for complete search history.

(56) References Cited

U.S. PATENT DOCUMENTS 3,910,215 A * 10/1975 Soderman ..... B63B 1/30
114/279
4,364,324 A * 12/1982 Warner ..... B63B 1/244
244/102 R
4,622,913 A * 11/1986 Williams ..... B63B 1/28
114/280
5,117,776 A * 6/1992 Thorpe ..... B63B 1/26
114/282
6,782,839 B1 * 8/2004 Nozaki ..... B63B 39/06
114/291
11,691,695 B2 * 7/2023 Bieker ..... B63B 1/285
114/280

* cited by examiner

SAFETY STRUT ASSEMBLY FOR HYDROFOIL CRAFT

CROSS-REFERENCE TO RELATED APPLICATION

This application is a National Stage Application under 35 U.S.C. § 371(a) of PCT/NL2021/050469, filed Jul. 22, 2021, which claims the benefit of and priority to Netherlands Patent Application No. 2026134 filed Jul. 24, 2020. The entire contents of all of the foregoing applications are incorporated by reference herein.

The invention relates to the field of hydrofoils for vessels and is directed to hydrofoils for mono-hull and multi-hull boats, in particular hydrofoil speedboats which are powered by an electrical motor. More particularly, the present invention relates to a safety strut assembly for a hydrofoil craft comprising a strut, which is attached to the hull of the craft by means of a transverse oriented strut axle for pivotal movement with respect to the hull, the assembly comprising: a control rod passing down through the strut; a linear actuator assembly; a hydrofoil pivotally mounted to the bottom portion of the strut about a transverse oriented foil axle, first linkage means connecting the hydrofoil to the control rod to vary the angular orientation thereof, second linkage means connecting the linear actuator assembly to the control rod.

BACKGROUND

Hydrofoil crafts have foils which move through the water during flight, that is, during foil-borne operation of the craft, and develop lift in much the same manner as an airplane wing. The foils are carried on struts which are attached to the hull of the craft and hold the hull clear of the water during flight. The struts are usually mounted on the hull in a manner which permits the struts to be retracted so that the hull can float on the water and the craft can be operated in a hull-borne mode as a normal ship.

Many vessels are known in the art that adopt some sort of foil system for improving stability and/or performance of the vessel. Generally, such hydrofoils are utilized in both multi-hull designs and in mono-hull designs.

A hydrofoil, or more simply, a foil is a streamline body designed to give lift and is similar to aircraft wings. The foil generally has a different curvature or camber at opposed surfaces thereof. The angle of attack (AoA) of a foil is the angle between the chord, defined as the straight line connecting the leading and trailing edge of the foil, and the direction of movement of the boat.

Hydrofoil craft generally include one, two or more struts that extend downwardly from the hull. At the lower end of the struts, hydrofoils are fixed to extend substantially orthogonal to the struts. When the craft reaches an appropriate speed, the hydrodynamic properties of the hydrofoil cause the hull to be lifted out of the water, leaving the craft "flying" on its hydrofoils.

Foils have typically been used on boats to reduce drag and to maintain trim in planing vessels. Foils are generally not used for steering nor for yaw.

In U.S. Pat. No. 6,782,839 in the name of Yanmar Diesel Engine Co. Ltd. a hydrofoil craft is disclosed having a retractable hydrofoil-strut, which strut is attached to the bottom of the craft and which strut can be rotated forward and rearward by a hydraulic cylinder. The hydrofoil is fixedly attached to the strut, a fixed foil, therefore the craft is trimmed by adjusting the angle of the propulsion and/or the flap at the stern of the craft. The fixed foil has the disadvantage, that during a sudden retraction movement of the strut, e.g. caused by hitting a floating object in the water while traveling at high speed, the foil remains in fixed position and orientation with respect to the strut, resulting in an extremely rapid downward deceleration, thereby abruptly dragging the craft downwards into the water, usually leading to damaging of the foil-support system and of the hull structure itself. This abrupt deceleration between the time of impact and the time of becoming hull-borne as the craft settles on the water can be quite dangerous to passengers, crew members and cargo on board the craft. The structural damage may be quite extensive and may involve sufficient damage to the hull to result in a hazardous situation as well as requiring extensive repairs to the craft.

A foil design has been shown for mono-hull keel boats as represented by U.S. Pat. No. 3,322,089 by Hook, which discloses a hydrofoil craft that uses fully submerged foils wherein the lift is varied by changing the AoA of the foil relative to the water flow.

When foil-borne operation is desired, the struts are moved to their extended position and locked in place. U.S. Pat. No. 3,322,089 is also directed towards finding a solution for the problem of rapid deceleration of the craft after a collision of a strut with a floating or submerged object in the water in unexpected or unpredictable places.

In an alternative design of the means to trim or control the fly-height of the craft as it moves through the water, the foil is attached to the strut in a pivotable manner. Usually, movement or rotation of the foil with respect to the strut is controlled by an actuator that is located within the hull. A control rod is connected between the actuator and the foil for communicating the forces generated by the actuator to the foil.

The bow strut in U.S. Pat. No. 3,322,089 is retracted forward and upward for operation in hull-born mode and the bow strut is allowed to yield and to move aftward and upward upon meeting an obstruction. After impact, the hydrofoil is released from the control rod passing down the strut, thereby allowing the foil to retract to a downward and aftward pivoted position to allow the obstruction to pass clear.

The aftward and downward rotation of the foil, however, alters the lifting pressure causing a downward and aftward pressure to be applied to the strut resulting in a rapid and forceful aftward retraction of the strut leading to damage to the foil-support system and to the hull structure, and also to a dangerous and unsafe situation for the passengers, crew members and cargo on board the craft. Furthermore, the control rod is disconnected from the foil after the impact, so that the strut must be repaired first before being able to resume foil-borne mode. Furthermore, the retraction mechanism is complicated and expensive, because the bow strut must be able to pivot forward and upward during normal operation and also be able to pivot aftward and upward when meeting an obstruction.

Another foil design and configuration are disclosed in United States patent application US 2017/0355424 by Smith, which is summarized as a load-bearing wing (foil) of the immersed type, of an upside-down "T" shape. This foil is connected to the strut through a pivot connection, the axis of which extends parallel to the keel of the craft, so that the foil can fold from a horizontal to a vertical orientation parallel to the strut. The foil is not connected to a control rod, so that the AoA is fixed. The axis of the pivot connection is not centred but offset in relation to the centre of hydrodynamic pressure of the foil. This asymmetry in construction enables the foil to fold back automatically when the strut is retracted aftward and upward caused by reversing of the lift of the fixed foil. The resulting reverse force acting on the outside surface of the foil causes the foil to fold into a position substantially parallel to the strut.

The aftward and upward rotation of the strut having a fixed foil, however, alters the lifting pressure causing a downward and aftward pressure to be applied to the strut resulting in a rapid and forceful aftward retraction of the strut leading to damage to the foil-support system and to the hull structure. Furthermore, a foil that can be pivoted around two orthogonal axes at the lower end of the struts is a complex and costly construction.

Documents U.S. Pat. Nos. 3,910,215 and 4,364,324 in the name of The Boeing Company disclose mechanical fuse devices comprising means for restraining the bow strut in its foil-borne position by a mechanical support which is designed to rupture upon striking a large, sizable object to permit the strut and the foil to pivot aftward and upward around the retraction pivot axis to a position near the hull or within a recess in the hull. For hull-borne operation of the craft, the bow strut moves pivotally in the forward direction in a slot or recess in the bow of the craft to the retracted position. The retraction mechanism must be able to both pivot the bow strut aftward when meeting an obstruction and to pivot the bow strut forward and upward from the extended position to the retracted position during normal operation. The mechanical linkage of the retraction mechanism is complicated and therefore expensive and susceptible to malfunction.

Document U.S. Pat. No. 4,622,913 in the name of The Boeing Company discloses a hydrofoil flap control rod system for transferring actuator induced forces to a hydrofoil flap. To control the attitude of the craft, a rectangular-shaped rod with wear pads within a rectangular conduit is connected between the actuator and the flap for communicating the push and pull forces generated by the actuator to the flap. Continuously exerting two-directional push and pull forces to the flap or the foil by the control rod requires a fixed connection between the actuator and the flap, so that the flap will decelerate the craft when hitting an floating object, thereby abruptly dragging the craft downward into the water. Furthermore, the bow strut is fixedly mounted to the hull and cannot be aftward retracted to the hull for hull-borne operation of the craft.

Document WO 92/22396 by Duncan discloses a strut with a hydrofoil, wherein the orientation of the hydrofoil is controlled by a mechanical mechanism comprising a surface sensor and a control rod extending through the strut. The mechanism is arranged such that an upward motion of the surface sensor causes a downwards trust in the control rod such that the angle of attack of the hydrofoil is increased, and that a downwards motion of the surface sensor causes an upward trust in the control rod such that the angle of attack of the hydrofoil is decreased. The control rod must be able to exert pulling and pushing forces on the hydrofoil, requiring a complicated design, guidance and control, and a thick, heavy weight control rod. Retraction of the strut and the surface sensor mechanism is done by slackening and tensioning cables, no measures are taken for preventing unsafe situations when hitting a floating object or when electrical systems fail.

SUMMARY

The object of the invention is therefore to wholly or partly remedy the disadvantages of the prior art. It is an object of the present invention to provide a safety strut assembly for a hydrofoil craft, more particular for an electrically powered hydrofoil speed boat, which safety strut assembly is intrinsically safe, e.g. in case of fault or breakdown of the electric systems. It is further an object of the invention to provide a strut assembly, which safely retracts when hitting an object floating in the water, without abrupt deceleration of the craft leading to dangerous and unsafe situations for the passengers, crew members and cargo on board the craft. It is an object of the invention to provide a safety strut assembly, which has a relatively simple construction incorporating a mechanical fuse device, retraction means and control means for the hydrofoil. In particular, it is an object of the invention to provide a safety strut assembly, which can be retracted and can be repositioned in the extended position easily. It is a further object of the invention to provide a control assembly in the safety strut assembly for controlling the AoA of the foil at the bottom of the safety strut, the control assembly allowing retraction and repositioning of the safety strut. It is a further object of the invention to provide a control rod and actuator assembly which enables a maximum power efficiency. It is a further object of the invention to provide a craft and hydrofoil construction which is cost efficient and relatively cheap and easy to manufacture and which has a lowest possible environmental impact. It is yet a further object to provide a hydrofoil craft which is safe and reliable.

These and further objects are realized by the present invention, wherein he first linkage means comprises a first drive ring mounted around the foil axle, wherein the first drive ring on the radial inner surface is provided with at least one first ring cam element, and wherein the foil axle on its radial outer surface is provided with at least one foil axle cam element, wherein the at least one foil axle cam element and the at least one first ring cam element are arranged to mutually engage and disengage.

In order to prevent deceleration of the craft by a negative AoA during retraction of the strut in de aftward direction, the foil is able to remain parallelly oriented in the direction of the movement of the craft and of the flow of the water by means of the first drive ring. When the strut pivots aftward with respect to the strut axle, the first drive ring also pivots with respect to the craft. Because the at least one first ring cam element disengages from the foil axle cam element of the foil axle, the foil axle and the attached foil are not forced to follow the pivoting movement of the strut and of the first drive ring, thereby allowing the foil axle and the foil to maintain their parallel position with respect to the flow of the water and to the hull of the craft.

In a further aspect of the present invention, the at least one first ring cam element is arranged to engage the at least one foil axle cam element and pivot the foil axle when a pulling force is exerted on the first linkage means by the control rod.

In another aspect of the present invention, the foil axle is able to freely pivot away from the engaging position of the at least one foil axle cam element with the at least one first ring cam element.

When the at least one first ring cam element engages the at least one foil axle cam element, the foil axle is pivoted and the AoA of the foil is adjusted. By continuously adjusting the AoA of the foil, the position and the orientation of foil-born craft above the waterline is maintained. By disengaging the at least one first ring cam element and at least one foil axle cam element, the foil axle and the attached foil may freely pivot within the first drive ring thereby preventing deceleration of the craft when retracting the strut aftward.

In another embodiment of the invention, the foil axle and the first drive ring each are provided with three cam elements, wherein these first cam elements are equally spaced apart, so that the foil axle and the foil are able to pivot freely over at least 85° degrees. When the foil is able to pivot over at least 85° degrees, the strut may be easily retracted for hull-borne operation, and may also be easily retracted when the strut hits an object, without the foil decelerating the craft. Furthermore, the force distribution on the foil axle is optimized over its circumference, allowing a smaller and more robust construction of the first linkage means, thereby decreasing drag and energy dissipation of this submerged portion of the strut.

A further embodiment of the invention provides for the second linkage means comprising a transverse oriented actuator axle, the actuator axle being coaxial with the strut axle, the second linkage means further comprising: a second drive ring mounted around the actuator axle, wherein the second drive ring on the radial inner surface is provided with at least one second ring cam element, and wherein the actuator axle on its radial outer surface is provided with at least one actuator axle cam element, wherein the at least one actuator axle cam element and the at least one second ring cam element are arranged to mutually engage and disengage.

With these measures, the linear actuator assembly is not required to follow the pivoting movement of the strut. The at least one second ring cam element disengages from the actuator axle cam element of the actuator axle, thereby allowing the linear actuator assembly to maintain their position within the hull of the craft during aftward pivoting of the strut.

In another aspect of the present invention, the at least one actuator axle cam element is arranged to engage the at least one second ring cam element and pivot the second drive ring when a pushing force is exerted on the second linkage means by the linear actuator assembly.

In another aspect of the present invention, the second drive ring is able to freely pivot away from the engaging position of the at least one second ring cam element with the at least one actuator axle cam element.

When the at least one actuator axle cam element engages the at least one second ring cam element, the second drive ring is pivoted by a pushing action of the linear actuator assembly and the control rod is pulled upward, and the AoA of the foil is adjusted by means of the first linkage means.

In another embodiment of the invention, the actuator axle and the second drive ring each are provided with three cam elements, wherein these second cam elements are equally spaced apart, so that the second drive ring of the second linkage means are able to pivot freely over at least 85° degrees. When the actuator axle with the connected linear actuator is able to pivot over at least 85° degrees, the strut may be easily retracted for hull-borne operation, and may also be easily retracted when the strut hits an object, without the need for displacing the linear actuating assembly together with the strut. Furthermore, the force distribution on the actuator axle is optimized over its circumference, allowing a smaller and more robust construction of the first linkage means, thereby decreasing drag and energy dissipation of this submerged portion of the strut.

In a special embodiment of the invention, a foil spring is provided between the strut and the foil axle, which foil spring is tensioned by retracting the strut into the horizontal hull-borne position within the recess of the hull, so that the tensioned foil spring will rotate the foil axle and the attached foil into a safe vertical transport position.

In yet another aspect of the invention, the linear actuator assembly is arranged for exerting pushing forces to the second linkage means and the control rod. When the linear actuator only has to exert a pushing force without requiring the option of a pulling force, the linear actuator can have a less complicated design and control, saving weight. Furthermore, this feature enables disengaging of the control rod when retracting the strut upward and aftward to the hull, preventing the need to displace the actuator assembly and preventing deceleration of the craft by the hydrofoil.

In yet another aspect, the second linkage means comprises a spring element, biasing/tensioning the second linkage means in the pushing direction of the linear actuator assembly.

Preferably, the spring element is a compression spring.

Due to the position of the centre of rotation before the centre of pressure, the hydrofoil will be forced to a negative AoA by the moving water during foil-borne operation. As a result, the control rod will be pushed downward, thereby pushing the second linkage means in the direction of the linear actuator and compressing/tensioning the spring element. This spring element substantially decreases the force the AoA actuator needs to generate, thus reducing the energy consumption of the control assembly of the foil.

In a special embodiment, the assembly further comprises a retraction assembly comprising a retraction actuator and retraction linkage means connected to the strut, the retraction assembly being adapted to pivot the strut aftward and forward in the keel direction about the strut axle.

In a further aspect of the present invention, the foil axle of the safety strut assembly, being the centre of rotation of the hydrofoil, is not coinciding with the centre of pressure of the hydrofoil in the keel direction of the craft, thereby enabling varying the angular orientation of the hydrofoil by a single direction displacement of the control rod and the first linkage means in the height direction of the craft.

In order to ensure that hydrofoil craft during high speed traveling in de foil-born mode will safely change/switch from foil-borne mode to hull-borne mode, e.g. in case of fault or breakdown of the electric systems, the centre of pressure of the force exerted by the water flow on the hydrofoil will orient the hydrofoil to an intrinsically safe position without requiring actuation and a force from the control rod.

In another aspect of the invention, the present subject matter is directed to the centre of rotation of the hydrofoil being located before the centre of pressure of the hydrofoil in the keel direction of the craft. The positioning of the centre of rotation of the hydrofoil before the centre of pressure creates a negative AoA of the hydrofoil and a force on the control rod during movement of the foil-borne craft. As a result, the negative AoA will force the craft to intrinsically safely switch to the hull-borne mode, e.g. in case of fault or breakdown of the electric systems. Furthermore, the intrinsically safe negative AoA without actuation ensures that switching from hull-borne mode to foil-borne mode is only possible with electrical control systems working properly.

In particular, the first linkage means is located before the centre of rotation of the hydrofoil in the keel direction of the craft, thereby enabling varying the angular orientation of the hydrofoil by a pulling force and displacement of the control rod in the height direction of the craft. By exerting a single direction pulling force on the first linkage means by the control rod, the hydrofoil will leave the intrinsically safe negative AoA orientation and hull-borne mode, enabling switching to foil-borne operation.

As a result, the AoA can only be adjusted from negative to positive by exerting a pulling force by the control rod originating from (a properly working) electrical control system such as the actuator assembly.

BRIEF DESCRIPTION OF THE DRAWINGS

The invention and the following detailed description of certain embodiment thereof may be understood by reference to the following figures.

DETAILED DESCRIPTION OF THE INVENTION

The invention is now described by the following aspects and embodiments, with reference to the figures.

For convenience of interpretation of the figures, the following terms are used. The terms vertical, horizontal and straight are to be understood as substantially vertical, horizontal respectively straight, whereby horizontal meaning: in the transverse direction of the width of the craft parallel to the waterline, whereby vertical meaning: in de height direction, perpendicular to the water surface, whereby the keel direction meaning: perpendicular to the transverse direction parallel to the water surface, from the stern to the bow.

Figure 1:
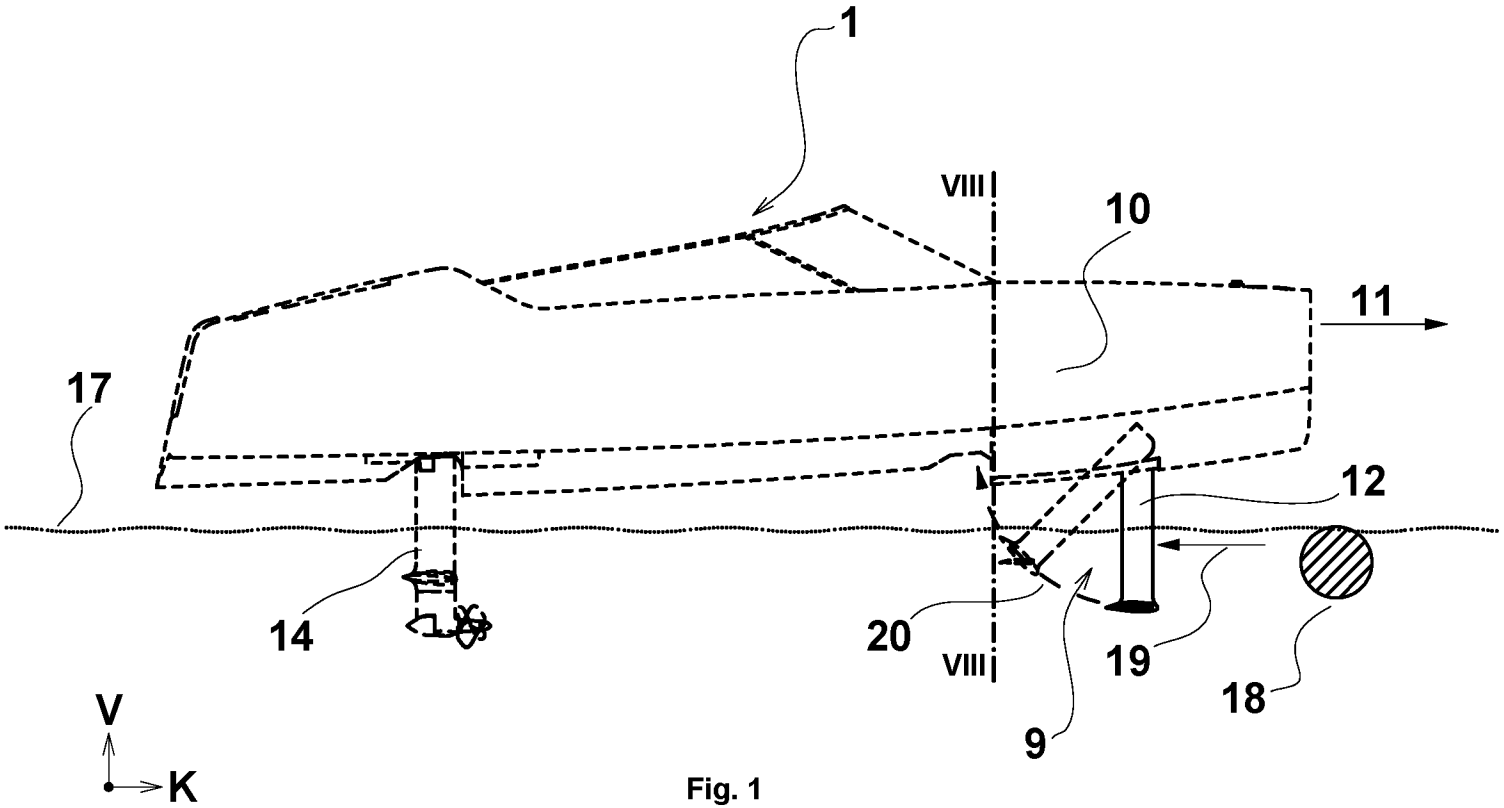
FIG. 1 shows is a side view of a typical hydrofoil craft in foil-borne operation.
Figure 2:
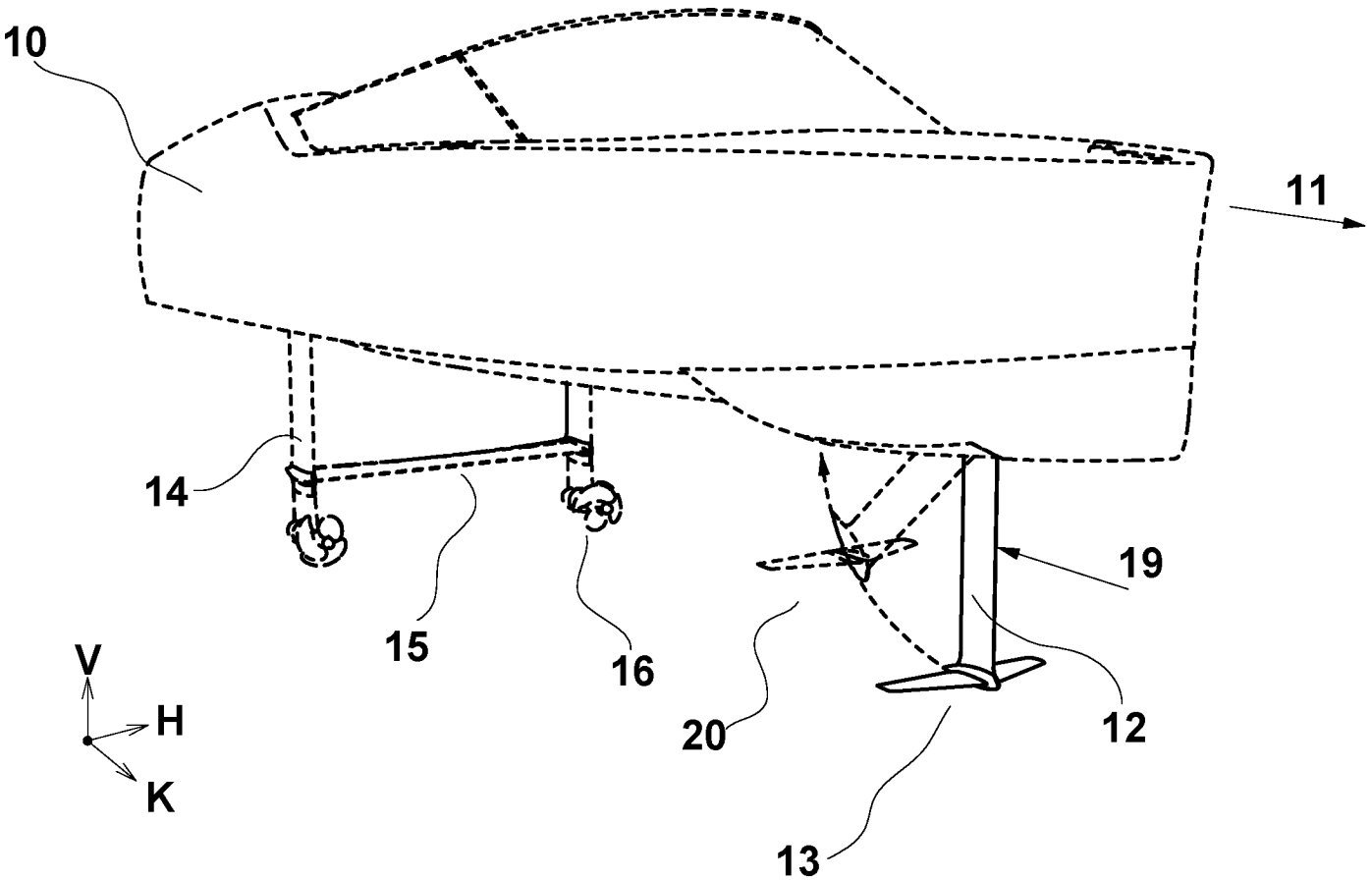
FIG. 2 shows a perspective view of the hydrofoil craft of FIG. 1.

FIGS. 1-2 show an overview of a hydrofoil craft for the safety strut assembly according to the invention.

Arrow V indicates the vertical direction, directing upwards from the water; arrow H indicates the transverse direction, directing from starboard to port side of the craft; arrow K indicates the keel direction, directing from the stern to the bow.

FIG. 1 shows a side view of a typical hydrofoil craft 1 which is here illustrated in foil-borne operation, traveling at high speed, indicated by arrow 11, above the water surface 17. Safety strut assembly 9 at the bow of the craft comprises a strut 12, which is supported on the hull 10 of the craft in a manner to permit pivotal movement in the aft direction of arrow 20 but is normally held against such movement during foil-borne operation by substantially rigid restraining means. The strut is retracted in the aft direction indicated by arrow 20 in a recess in the hull when hull-borne operation of the craft is desired. For foil-borne operation of the flight, the strut is repositioned in the extended position. If an impact force, or a force in excess of the normal load, is applied to the strut, it is adapted to yield and permit pivotal movement in the aft direction indicated by arrow 20.

Furthermore, a floating (semi)submerged object 18 is shown that could cause a collision, indicated by arrow 19.

FIG. 2 shows a perspective view of the typical hydrofoil craft 1 of FIG. 1, which craft is illustrated here as including a pair of hydrofoils, there being a bow foil 13 mounted on the bow strut 12 beneath the bow of the craft and a second hydrofoil 15 mounted on two vertical struts 14 beneath the stern of the hull 10 of the craft. The stern struts 14 are provided with propellers 16 for propulsion of the craft. The type of propulsion for the craft is not essential for the invention. A mechanical propulsion may be provided, but also alternative propulsions may be provided, like a hybrid diesel electrical propulsion, a waterjet or an electrical propulsion including batteries for storage of electrical energy. Nevertheless, it has to be understood that other means of propulsion may be employed without departing of the gist of the invention.

Figure 3:
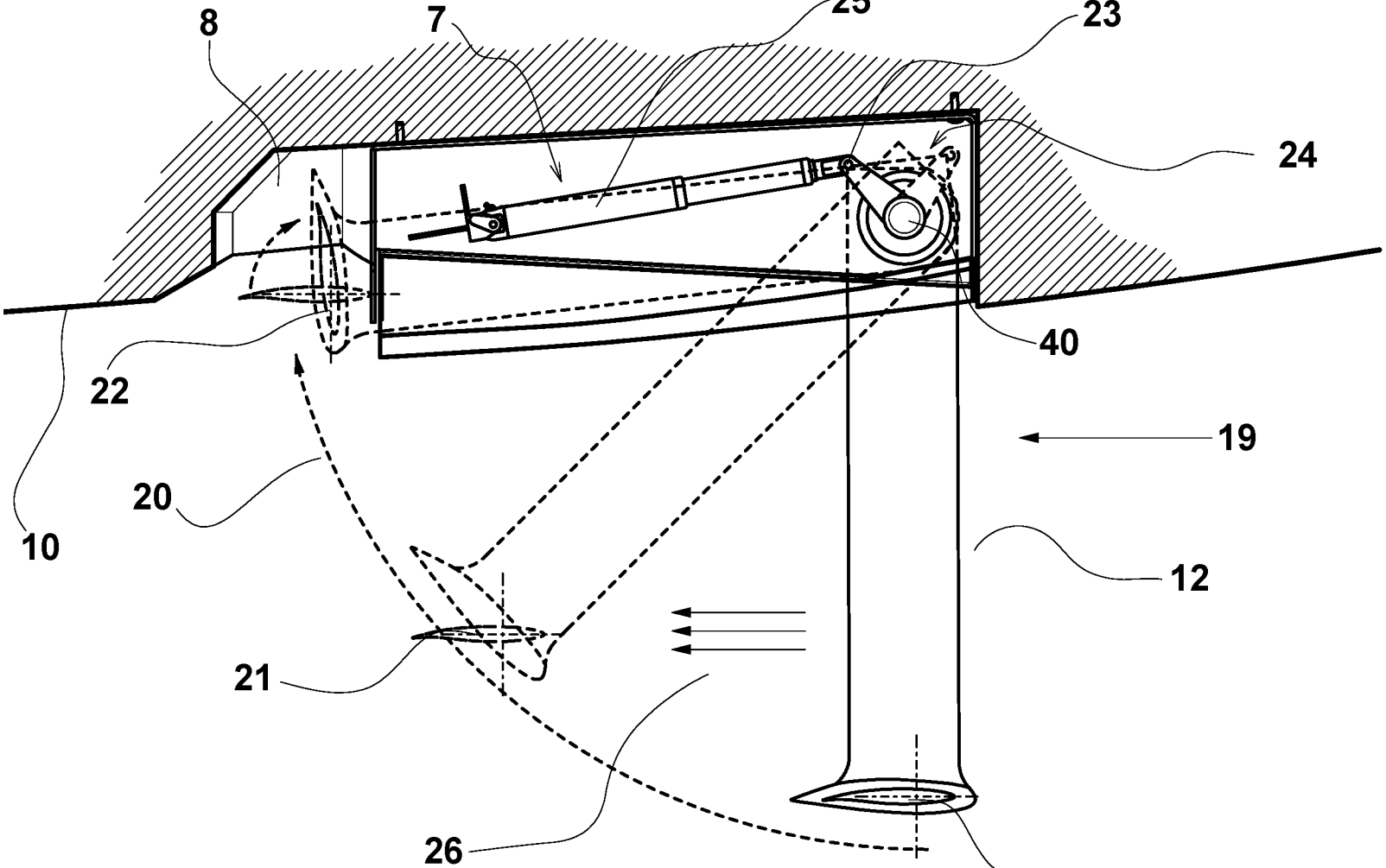
FIG. 3 shows a side view of the bow strut with retraction means of FIGS. 1 and 2.

FIG. 3 shows a side view of the bow strut retraction mechanism 7, here illustrating the movement indicated by arrow 20 of the bow strut 12 with the bow foil 13 when being retracted into the boat's hull.

The bow strut retraction mechanism 7 comprises a retraction actuator 25 and retraction linkage means 24. When hull-borne mode operation is required, the bow strut 12 can be retracted aftward and upward about a bow strut axle 40 into a recess 8 provided in the hull 10, by means of the retraction linkage means 24. When foil-born mode operation is desired, the bow strut 12 is moved into the upright, extended position by the bow strut retraction mechanism 7.

A safety release system (also indicated by mechanical fuse device) is provided to the bow strut retraction mechanism, which release system ensures that the bow strut retracts and moves aftward and upward upon meeting an obstruction such as submerged object 18 (see FIG. 1). The safety release system may be of any suitable type, it may be designed simply to rupture and release the strut, permitting it to swing in the aft direction in response to the impact force. The safety release system thus functions as a mechanical fuse device by rupturing or failing in a predetermined manner. The mechanical failure is thus confined to an easily replaceable element or device and any other structural damage is prevented or minimized. In the embodiment shown, a breaking pin 23 is mounted between the retraction actuator 25 and the retraction linkage means 24. The breaking pin 23 ruptures upon striking a sizable submerged object 18 by the bow strut 12 permitting the bow strut and the bow foil 13 to yield and to move aftward and upward into recess 8 according to arrow 20.

This safety release system limits or reduces the possible structural damage by providing a predetermined failure path. However, when during the retraction movement in the direction of arrow 20 the bow foil 13 remains in fixed position and orientation with respect to the bow strut, a large negative AoA will occur which will decelerate the craft and will cause a downward deceleration dragging the craft downwards into the water. The linkage system according to the invention permits the bow strut 12, in response to the impact force of arrow 19 of a floating or submerged object 18, to make a pivotal movement in the direction of arrow 20 in the aft direction, while keeping the foil in the horizontal position 21 in the water flow 26. As a result, abrupt deceleration is prevented, allowing the craft to slow down and to settle onto the water 17 at a safe rate of deceleration.

First Embodiment

FIGS. 4-6, 9 show a first embodiment of the safety strut assembly for the hydrofoil craft 1 according to the invention.

Figure 4:
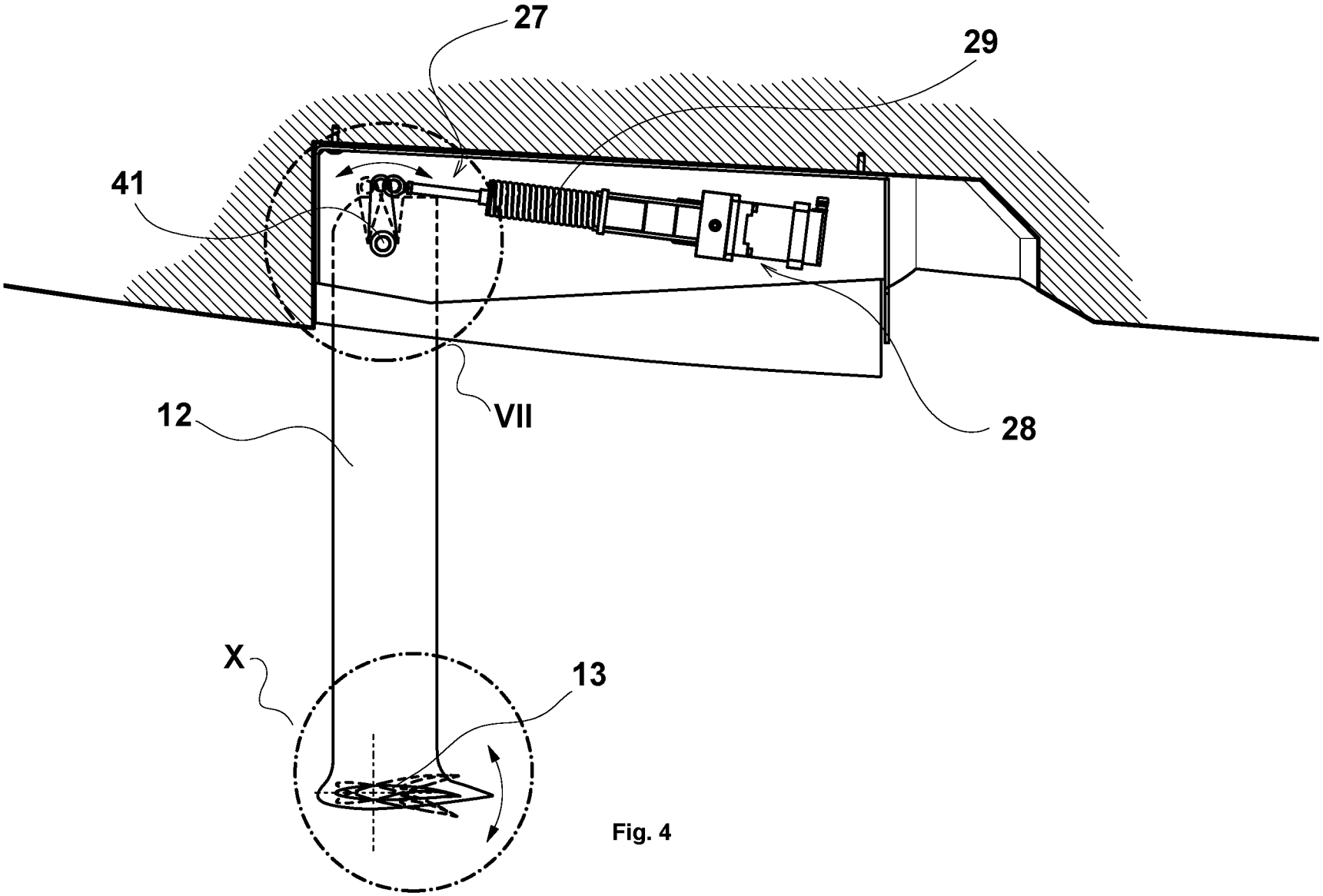
FIG. 4 shows a side view of the bow strut AoA control assembly.

FIG. 4 shows a side view of the foil Angle of Attack (AOA) control mechanism of the bow strut, here illustrating the position of the main components, including the foil 13, second linkage means 27, actuator axle 41, spring element 29 and linear actuator assembly 28.

Figure 5:
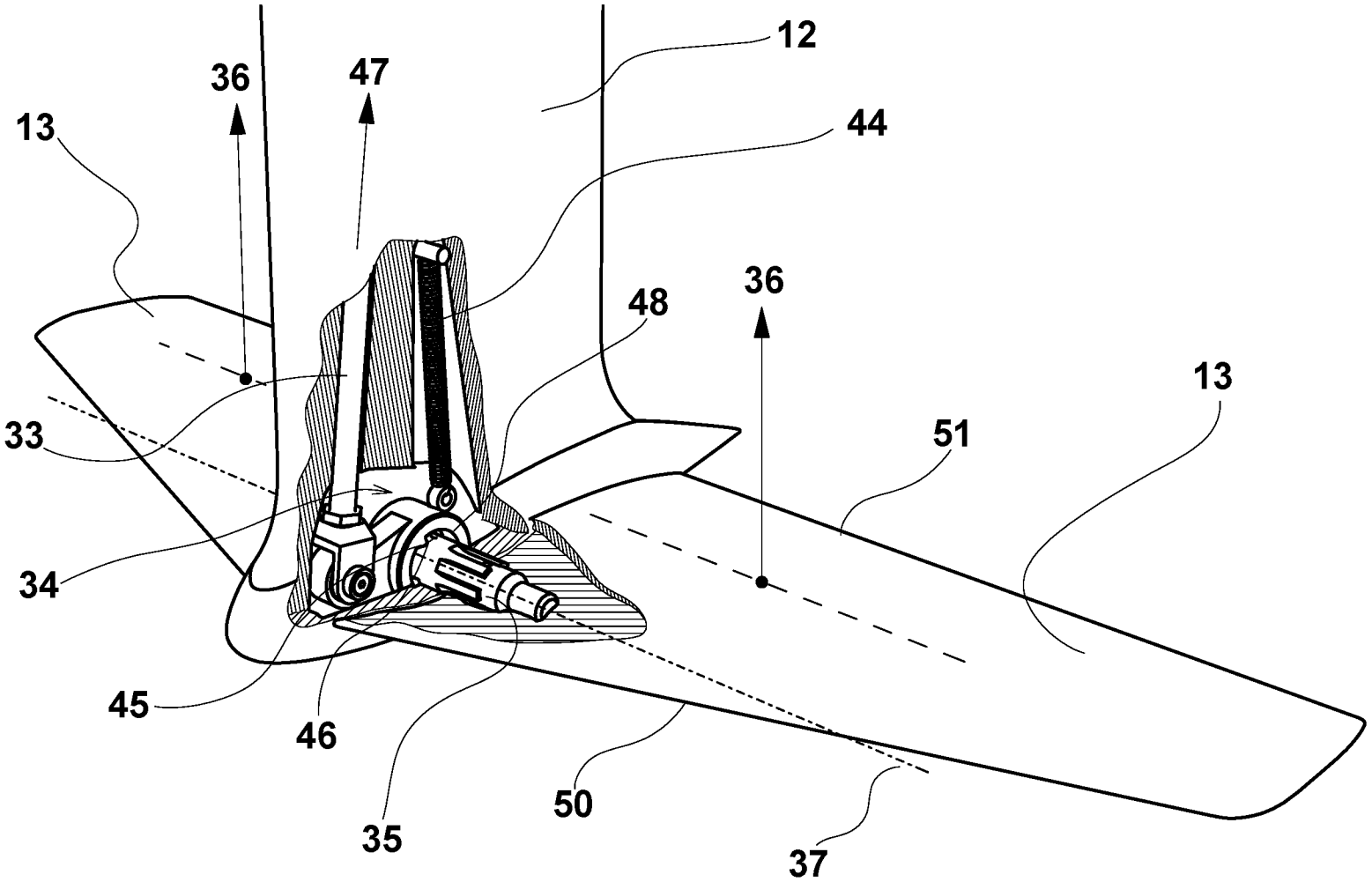
FIG. 5 shows a perspective view of the bow strut with hydrofoil.

FIG. 5 shows a perspective view of the foil 13 and the strut 12, with a fragmentary sectional view illustrating: the mechanism to control the AOA of the foil 13, control rod 33, first linkage means 34, foil axle 35, the Center of Pressure (COP) line 36, the Center of Rotation (COR) line 37, and foil spring 44.

Figure 6:
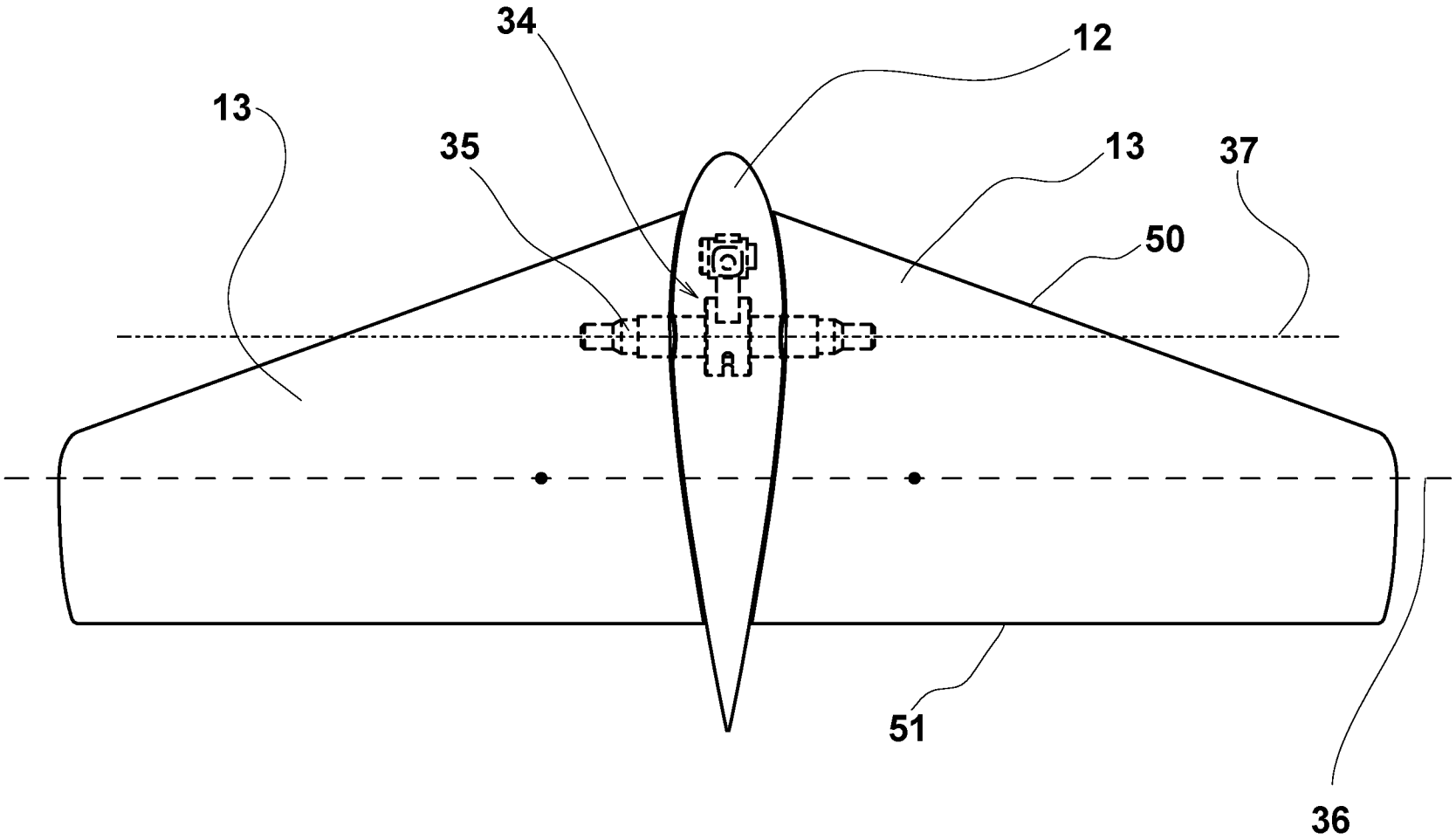
FIG. 6 shows a bottom view of the hydrofoil of the bow strut.

FIG. 6 shows a bottom view of the foil 13, illustrating that the position of the Center of Rotation (COR) line 37 is placed in front of the Center of Pressure (COP) line 36.

Figure 9:
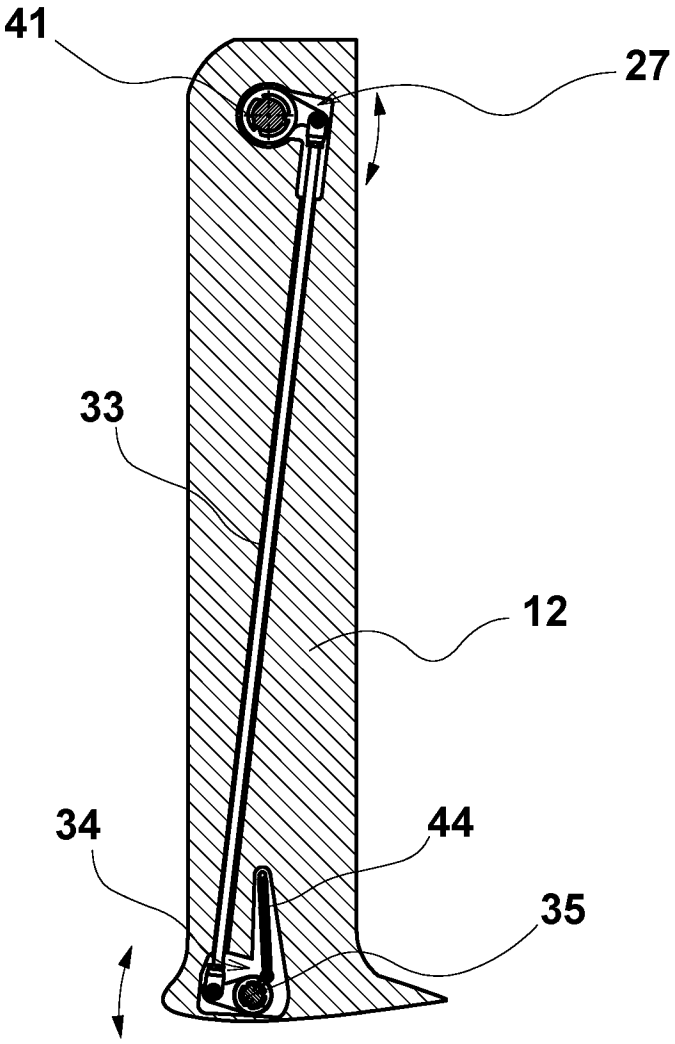
FIG. 9 shows a cross-sectional view of the bow strut with control rod and first and second linkage means.

FIG. 9 shows the strut 12 of the retractable safety strut assembly according to the invention, with second linkage means 27 and first linkage means 34 connected by control rod 33.

FIGS. 4 and 9 show in more detail the hydrofoil control mechanism in the strut 12 for maintaining the optimal orientation of the craft during foil-borne mode traveling of the craft. Linear actuator assembly 28 is connected with second linkage means 27 to control rod 33. Control rod 33 extends downward through the bow strut 12 to first linkage means 34. First linkage means 34 connects the control rod 33 to the hydrofoil 13. The linear actuator assembly 28 is now able to adjust the AoA of the hydrofoil 13 and maintain the optimal position of the craft during foil-born travel.

In FIGS. 5-6 is shown, that according to the invention the Center of Rotation (COR) line 37 of the hydrofoil 13 is not coinciding with line of the Center of Pressure (COP) 36 of the hydrofoil 13. Thus, during travel/flight or movement through the water of the hydrofoil, the pressure of the water, exerted on the hydrofoil, will force the hydrofoil into an (safe) orientation determined essentially by the mutual distance and position of the COR and the COP.

The non-coinciding placement of the COR 37 and the COP 36, compared to a coinciding COR 37 and COP 36, has the advantage that a single direction displacement of the control rod 33 is sufficient in controlling the orientation of the foil 13. If the COR 37 and COP 36 were coinciding, e.g. were located in the same position, this would result in requiring both push and pull forces for controlling the orientation and the AoA of the foil 13, so that the control rod 33 must be a fixed connection between the linear actuator assembly 28 and the foil 13. Having non-coinciding COR and COP, and a single direction displacement of the control rod 33, allows for an intrinsically safe foil 13, which has the freedom to return to its safe orientation by the pressure exerted by the flowing water.

In a more advanced embodiment as shown in FIGS. 5-6, the Center of Rotation (COR) line 37 is positioned in front of the line of the Center of Pressure (COP) 36 of the bow foil 13. Thus, during travel/flight, the trailing portion 51 of the bow foil is moved upward and the leading portion 50 is moved downward into a negative AoA creating a downward acceleration of the craft.

Positioning the COR 37 of the hydrofoil before the COP 36 creates an intrinsically safe negative AoA of the hydrofoil during travel/flight of the craft and a force on the control rod during movement of the foil-borne craft through the water. As a result, the negative AoA will force the craft to switch to the intrinsically safe hull-borne mode, e.g. in case of fault or breakdown of the electric systems. Furthermore, the intrinsically safe orientation of the foil 13 is advantageous during the start of the travel of the craft, when the craft is hull-borne. The intrinsically safe negative AoA of the foil 13, when not actuated, ensures that switching from hull-borne mode to foil-borne mode is only possible with electrical control systems working properly.

Second Embodiment

FIGS. 5-6 and 9-10 show in more detail the first linkage means 34 according the invention for maintaining the foil 13 in a safe horizontal position, parallel to the water surface 17 and in the direction of movement 11 of the craft, during retraction of the bow strut 12.

Figure 10:
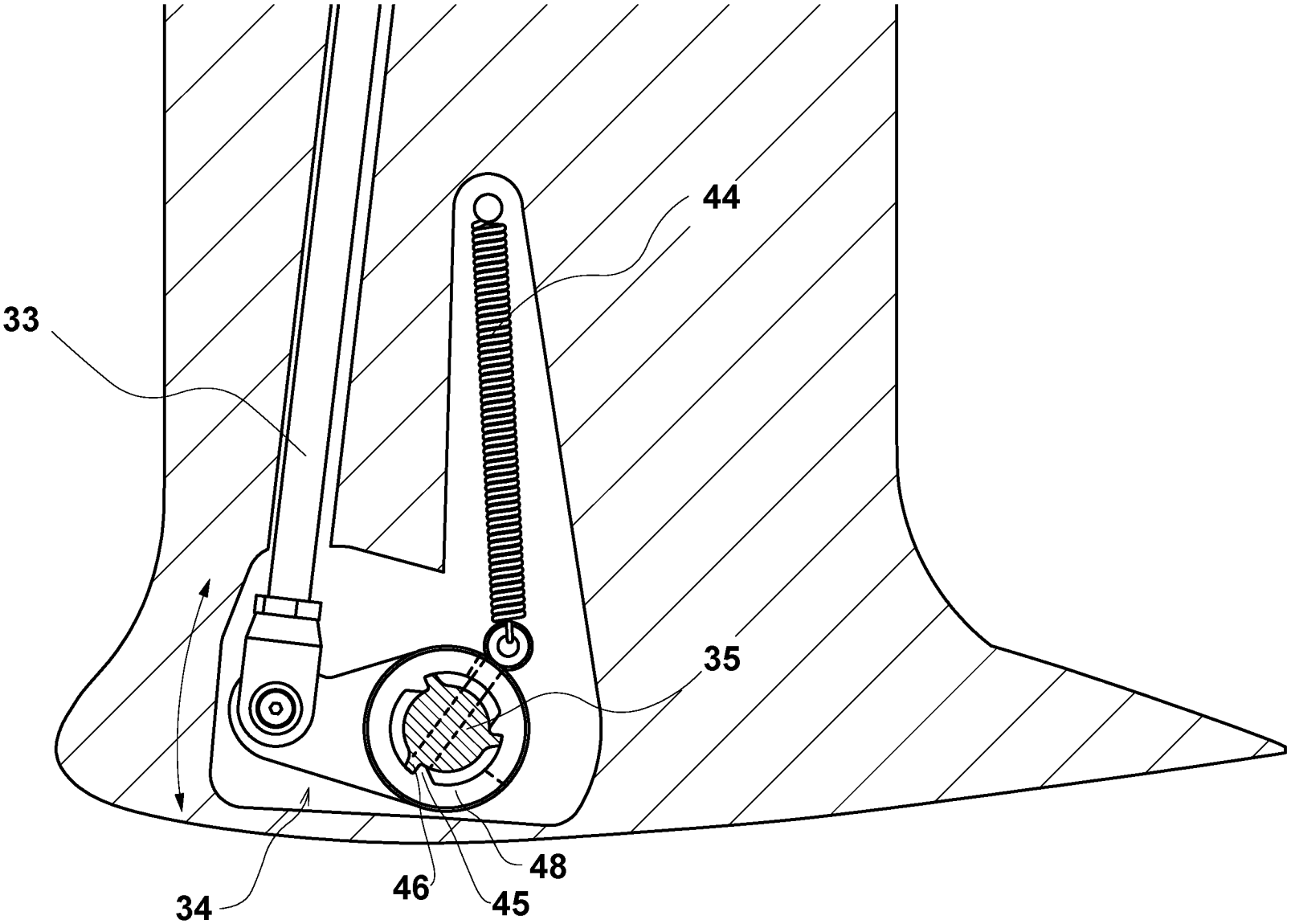
FIG. 10 shows in more detail the first linkage means of FIG. 9.

FIGS. 5 & 10 show the bottom part of the strut 12 and the foil 13 at the bow of the craft. The control rod 33 passes down through the strut 12 (see FIG. 9) from the linear actuator assembly 28 (see FIG. 4). The foil 13 is pivotally mounted on the strut 12 in a manner that it is controlled by the linear actuator assembly 28 by means of control rod 33 and generates lift when the strut is in the extended position and locked in place. In case the strut 12 makes a pivotal movement 20 in the aft direction, the foil 13 can move freely with the flow of the water 26 (see FIG. 3) thus not generating lift or decelerating the craft. Control rod 33 is connected through first linkage means 34 with foil axle 35. The first linkage means 34 comprise a first drive ring 48 mounted around the foil axle 35. The first drive ring 48 on the radial inner surface is provided with at least one first ring cam element 45 and the foil axle 35 on the radial outer surface is provided with at least one foil axle cam element 46. The first ring cam element 45 and the foil axle cam element 46 are arranged to mutually engage and pivot the foil axle 35, when the control rod 33 exerts a pulling force on the first linkage means 34 in the direction of arrow 47. A pulling force of the control rod 33 pivots the foil axle clockwise in FIGS. 5-6 and 10, thereby moving the leading portion 50 of the foil 13 upward and the trailing portion 51 downward creating an upward acceleration of the craft. The foil axle 35 is permitted to pivot freely counter-clockwise when the pulling force of the control rod 33 is removed or the strut 12 is retracted and moves aftward and upward into recess 8 of the hull 10 according to arrow 20 (see FIG. 3). As a result, the horizontal, parallel orientation of the foil 13 with respect to the water surface and the direction of the water flow 26 is maintained, so that abrupt deceleration of the craft is prevented and the craft can slow down and settle onto the water 17 at a safe rate of deceleration. In the embodiment of the invention shown in FIGS. 5, 9 and 10 three sets of engaging cam elements are provided, equally spaced apart, thereby permitting the foil axle 35 and the connected foil 13 to pivot freely over at least 85 degrees.

In FIG. 10 (circle X of FIG. 4) a foil spring 44 is mounted between the strut 12 and the foil axle 35. The foil spring 44 is tensioned when the strut is retracted and rotating aftward and upward in the direction of the recess 8 in the hull (see FIG. 3). When the strut 12 has reached position 22 after intermediate position 21, the foil spring 44 will rotate the foil axle 35 and the attached foil 13 counter clockwise into a safe vertical transport position.

Third Embodiment

Figure 7:
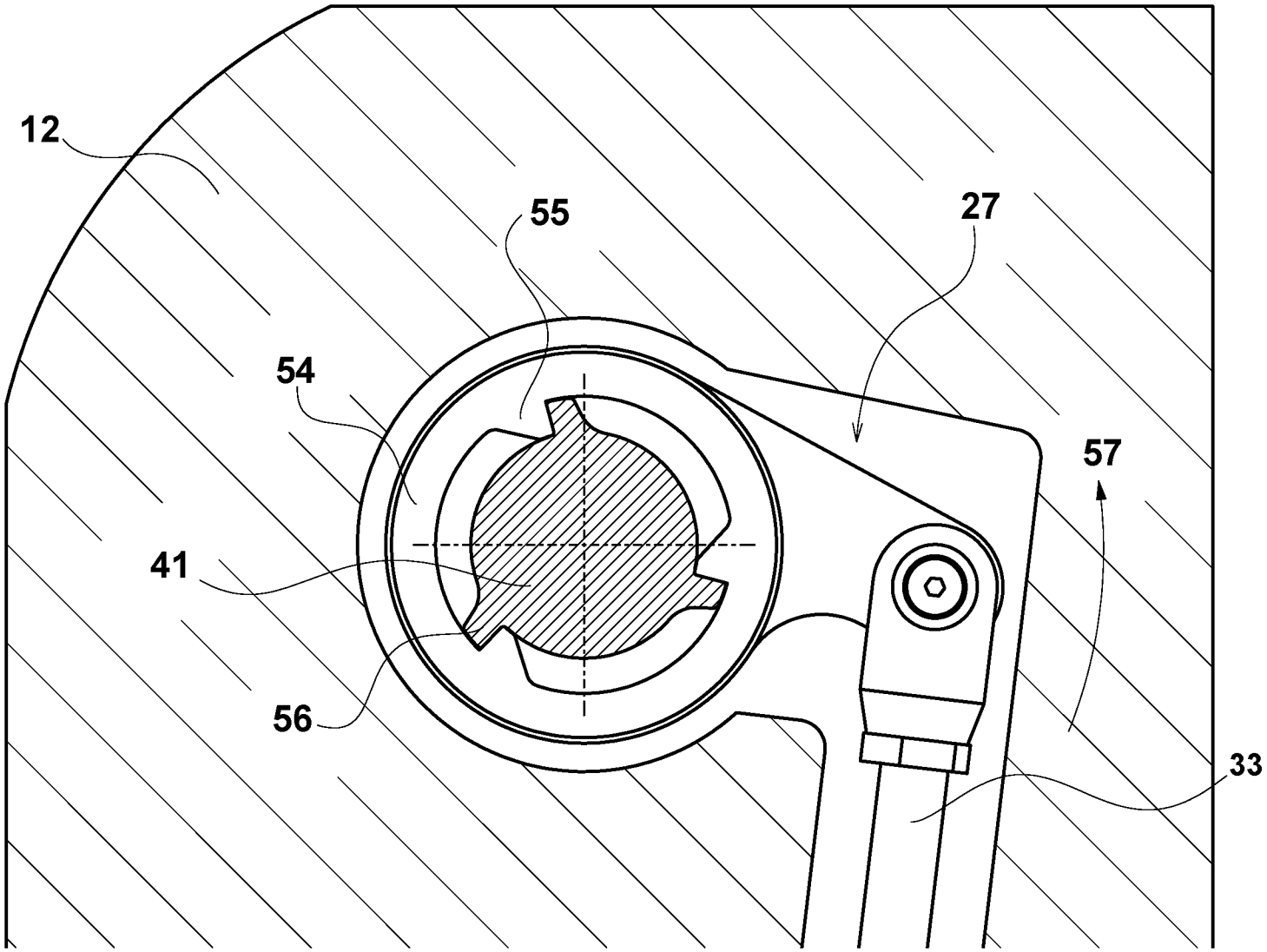
FIG. 7 shows a fragmentary sectional view, detailing the second linkage means of the bow foil axle.

FIGS. 7, 9 and 10 show a third embodiment of the hydrofoil craft 1 according to the invention.

FIG. 7 shows in more detail (circle VII of FIG. 4) the second linkage means 27, which connects the linear actuator assembly 28 (see FIG. 4) to the control rod 33. The second linkage means 27 comprises a second drive ring 54 mounted around the actuator axle 41. The radial inner surface of the second drive ring is provided with at least one second ring cam element 55. The actuator axle 41 on its radial outer surface is provided with at least one actuator axle cam element 56. The actuator axle cam element 56 and the one second ring cam element 55 are arranged to mutually engage and disengage. When a pushing force is exerted by the linear actuator on the second linkage means 27, the actuator axle 41 will pivot the second drive ring 54 counter clockwise, and will pull the control rod 33 upward in the direction of arrow 57. The second drive ring 54 is permitted to pivot freely further counter-clockwise when the strut 12 is retracted and moves aftward and upward into recess 8 of the hull 10 according to arrow 20 (see FIG. 3). Accordingly, by allowing free pivoting of the second drive ring 54 of the strut 12, the actuator axle 41 and the linear actuator assembly 28 are permitted to maintain their position and are not forced to follow the pivoting movement of the strut 12. Because the second ring cam element 55 disengages from the actuator axle cam element 56 of the actuator axle 41, the linear actuator assembly is allowed to maintain its position within the hull of the craft during the aftward pivoting of the strut 12.

In the embodiment of the invention shown in FIGS. 7 and 9 three sets of engaging cam elements are provided, equally spaced apart, thereby permitting the second drive ring 54 of the second linkage means 27 to pivot freely over at least 85 degrees.

The actuator axle 41 is coaxial with the strut axle 40, e.g. an axle in axle construction extending on two sides of the strut in the transverse direction of the craft. The actuator axle 41 is coaxial with the strut axle 40 to be able to retract and rotate the strut with the control rod.

FIG. 9 shows the strut 12 of the bow of the craft, as seen from port side, provided with a control rod 33 connected to first linkage means 34 comprising a first drive ring 48, and connected to second linkage means 27 provided with a second drive ring 54. Advantageously, this construction for the safety strut assembly allows for a safe and swift retraction of the strut, while minimizing the chance on damage to the control mechanism for the bow hydrofoil.

Figure 8:
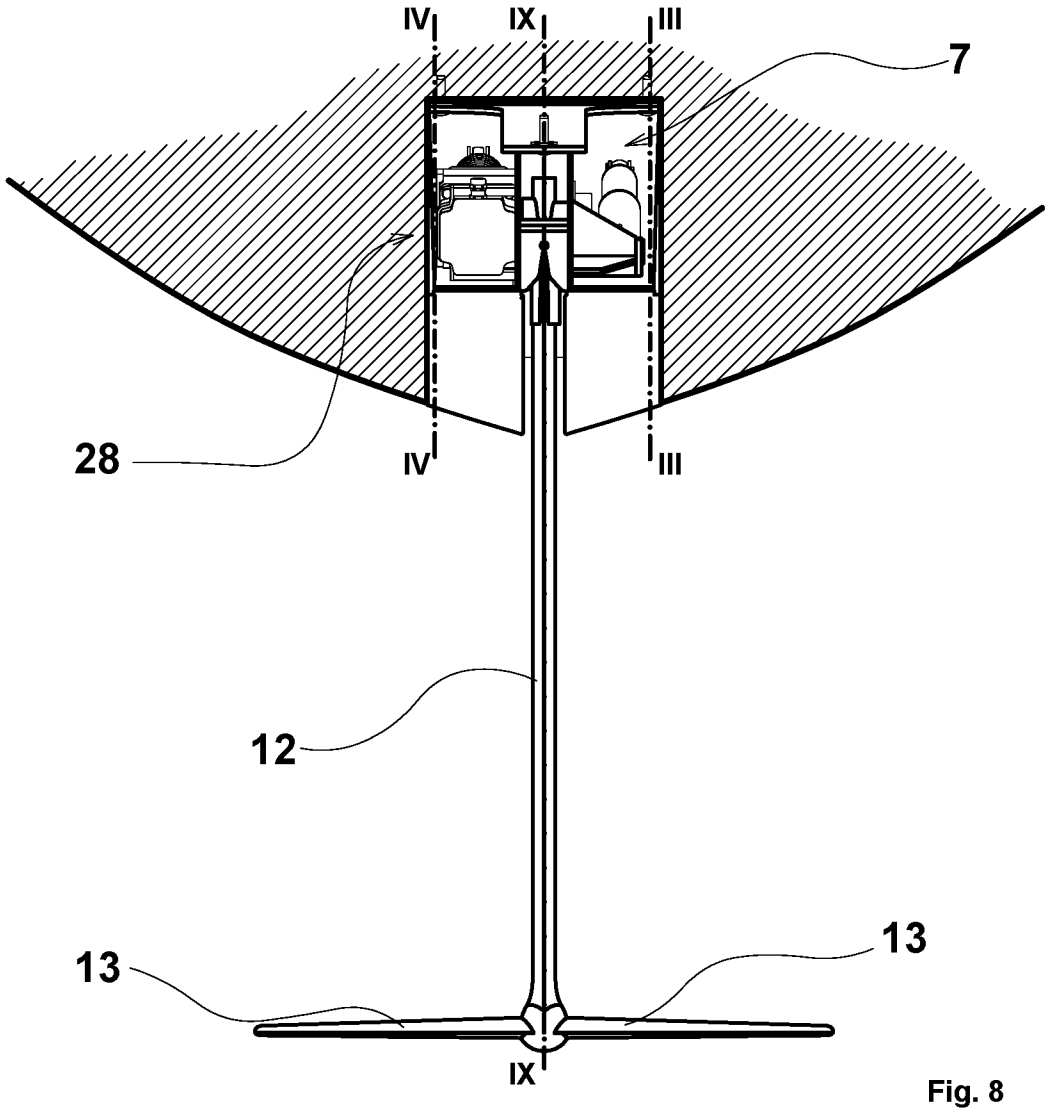
FIG. 8 shows a rear view of the bow strut with retraction assembly and actuator assembly.

FIG. 8 is a cross-sectional view over line VIII-VIII in FIG. 1, which shows a rear view of the strut 12 with retraction assembly 7 and actuator assembly 28. Seen from starboard, a cross-section of retraction assembly 7 over line III-III is shown in FIG. 3. Seen from port side, a cross-section of actuator assembly 28 over line IV-IV is shown in FIG. 4. FIG. 9 is a cross-sectional detailed view over line IX-IX in FIG. 8, as viewed from port side of the craft.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The term "and/or" includes any and all combinations of one or more of the associated listed items. The article "a" or "an" preceding an element does not exclude the presence of a plurality of such elements. The article "the" preceding an element does not exclude the presence of a plurality of such elements. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A safety strut assembly for a hydrofoil craft comprising:
- a strut, which is attached to a hull of a craft by means of a transverse oriented strut axle for pivotal movement with respect to the hull;
- a control rod passing down through the strut;
- a linear actuator assembly;
- a hydrofoil pivotally mounted to a bottom portion of the strut about a transverse oriented foil axle;
- first linkage means connecting the hydrofoil to the control rod to vary angular orientation thereof; and
- second linkage means connecting the linear actuator assembly to the control rod;
- wherein the first linkage means comprises a first drive ring mounted around the foil axle,
- wherein the first drive ring on its radial inner surface is provided with at least one first ring cam element,
- wherein the foil axle on its radial outer surface is provided with at least one foil axle cam element, and
- wherein the at least one foil axle cam element and the at least one first ring cam element are arranged to mutually engage and disengage.

2. The safety strut assembly according to claim 1, wherein the at least one first ring cam element is arranged to engage the at least one foil axle cam element and pivot the foil axle when a pulling force is exerted on the first linkage means by the control rod.

3. The safety strut assembly according to claim 1, wherein the foil axle freely pivotable away from the engaging position of the at least one foil axle cam element with the at least one first ring cam element.

4. The safety strut assembly according to claim 1, wherein each of the foil axle and the first drive ring is provided with three first cam elements that are equally spaced apart, so that foil axle and the hydrofoil freely pivotable over at least 85° degrees.

5. Safety strut assembly (9) according to claim 1, wherein the second linkage means comprises a transverse oriented actuator axle, the actuator axle being coaxial with the strut axle, the second linkage means further comprising:
- a second drive ring mounted around the actuator axle,
- wherein the second drive ring on its radial inner surface is provided with at least one second ring cam element, and
- wherein the actuator axle on its radial outer surface is provided with at least one actuator axle cam element,
- wherein the at least one actuator axle cam element and the at least one second ring cam element are arranged to mutually engage and disengage.

6. The safety strut assembly according to claim 5, wherein the at least one actuator axle cam element is arranged to engage the at least one second ring cam element and pivot the second drive ring when a pushing force is exerted on the second linkage means by the linear actuator assembly.

7. The safety strut assembly according to claim 5, wherein the second drive ring freely pivotable away from the engaging position of the at least one second ring cam element with the at least one actuator axle cam element.

8. The safety strut assembly according to claim 5, wherein the actuator axle and the second drive ring each are provided with three second cam elements that are equally spaced apart, so that the second drive ring of the second linkage means is freely pivotable over at least 85° degrees.

9. The safety strut assembly according to claim 5, wherein a foil spring is provided between the strut and the foil axle, wherein the foil spring is tensioned by retracting the strut into a horizontal hull-borne position within a recess of the hull, so that the tensioned foil spring rotates the foil axle and the attached hydrofoil into a safe vertical transport position.

10. The safety strut assembly according to claim 1, wherein the linear actuator assembly is arranged for exerting pushing forces to the second linkage means and the control rod.

11. The safety strut assembly according to claim 10, wherein the second linkage means comprises a spring element, biasing the second linkage means in the pushing direction of the linear actuator assembly.

12. The safety strut assembly according to claim 11, wherein the spring element is a compression spring.

13. The safety strut assembly according to claim 1, wherein the assembly further comprises a retraction assembly comprising a retraction actuator and retraction linkage means connected to the strut, the retraction assembly being adapted to pivot the strut aftward and forward in a keel direction about the strut axle.

14. The safety strut assembly according to claim 13, wherein the foil axle, being a centre of rotation of the hydrofoil, is not coinciding with the centre of pressure of the hydrofoil in the keel direction of the craft, thereby enabling varying the angular orientation of the hydrofoil by a single direction displacement of the control rod and the first linkage means in a height direction of the craft.

15. The safety strut assembly according to claim 14, wherein the centre of rotation of the hydrofoil is located before the centre of pressure of the hydrofoil in the keel direction of the craft.

16. The safety strut assembly according to claim 15, wherein the first linkage means is located before the centre of rotation of the hydrofoil in the keel direction of the craft, thereby enabling varying the angular orientation of the hydrofoil by a puling force and displacement of the control rod in the height direction of the craft.

* * * * *